US006357808B1

(12) United States Patent
Supernat

(10) Patent No.: US 6,357,808 B1
(45) Date of Patent: Mar. 19, 2002

(54) OPERATING FITTING FOR SLIDING DOOR OR WINDOW PANEL

(75) Inventor: Thierry Supernat, Nebing (FR)

(73) Assignee: Ferco International Ferrures et Serrures de Batiment

( * ) Notice: Subject to any disclaimer, the term of this patent is extended or adjusted under 35 U.S.C. 154(b) by 0 days.

(21) Appl. No.: 09/513,836

(22) Filed: Feb. 25, 2000

(30) Foreign Application Priority Data

Mar. 23, 1999 (FR) ..... 99 03599

(51) Int. Cl.[7] ..... E05B 3/00

(52) U.S. Cl. ..... 292/348; 292/145; 292/138; 292/DIG. 53; 292/DIG. 46; 16/412; 16/415

(58) Field of Search ..... 16/412, 415; 49/181, 49/183, 449, 460; 292/348, 346, 347, 350, 351, 357, DIG. 53, 1, DIG. 64, 146, 98, 100, 170, 187, 152, 165, 145, 139, 143, 140, 337, 120, 128, 162, 166, 173, 174, 175, DIG. 24, DIG. 30, DIG. 31, DIG. 37, DIG. 38, DIG. 20, DIG. 49, DIG. 63, DIG. 54, DIG. 55

(56) References Cited

U.S. PATENT DOCUMENTS

| | | | | | |
|---|---|---|---|---|---|
| 2,668,319 | A | * | 2/1954 | Keys et al. | 16/412 |
| 3,353,855 | A | * | 11/1967 | Smith | 292/65 |
| 4,024,739 | A | * | 5/1977 | Kaufman | 292/DIG. 46 X |
| 4,470,624 | A | * | 9/1984 | Bisbing | 292/337 X |
| 4,570,471 | A | | 2/1986 | Crepinsek | |
| 4,640,051 | A | * | 2/1987 | Maier et al. | 49/348 |
| 4,754,624 | A | * | 7/1988 | Fleming et al. | 70/95 |
| 5,934,719 | A | * | 8/1999 | Athanasios | 292/145 X |
| 6,019,400 | A | * | 1/2000 | Prevot et al. | 292/145 |
| 6,050,617 | A | * | 4/2000 | Prevot et al. | 292/140 |
| 6,076,866 | A | * | 6/2000 | Prevot et al. | 292/140 |
| 6,089,625 | A | * | 7/2000 | Prevot et al. | 292/140 X |
| 6,270,129 | B1 | * | 8/2001 | Prevot et al. | 292/162 |

FOREIGN PATENT DOCUMENTS

| | | |
|---|---|---|
| DE | 1428516 | 5/1969 |
| DE | 2449741 | 4/1976 |
| DE | 29620880 | 1/1997 |
| FR | 2518628 | 6/1983 |
| FR | 2761719 | 10/1998 |

* cited by examiner

*Primary Examiner*—Anthony Knight
*Assistant Examiner*—Ruth C. Rodriguez
(74) *Attorney, Agent, or Firm*—Bachman & LaPointe, P.C.

(57) ABSTRACT

An operating fitting for a sliding door or window panel includes an adjustable fixing member which includes a rotary clamping member which bears on a location other than a visible face of a cover plate so as not to be visible on the corresponding visible face of a structural member. The rotary clamping member produces a force clamping the cover plate against the corresponding visible wall of the structural member or operates or immobilizes a system for producing a force of this kind.

9 Claims, 4 Drawing Sheets

OPERATING FITTING FOR SLIDING DOOR OR WINDOW PANEL

BACKGROUND OF THE INVENTION

1. Field of the Invention

The present invention relates to an operating fitting for a sliding door or window panel in which the stile at the leading edge is a structural member having two visible lateral walls with an empty interior chamber of the structural member between them.

2. Description of the Prior Art

Many operating fittings of the aforementioned type are known in the art.

For obvious security reasons, to prevent removing the fitting from the outside of the panel, one such operating fitting is a simple maneuvering fitting or housing adapted to be fixed to the outside wall of the structural member, i.e. the wall of the structural member facing outward relative to the sliding panel. No fixing member of a fitting or housing of this kind must be visible.

An operating fitting of the above kind can equally be a lock fitting adapted to be fixed to the inside wall of the structural member, i.e. the wall of the structural member facing inward relative to the sliding panel, to enable the panel to be locked and unlocked from inside the room in which the panel is installed.

In a manner that is known in the art, an operating fitting of the aforementioned type includes a body adapted to penetrate into the chamber of the structural member through an opening formed in the corresponding visible wall of said member and a cover plate which is an integral part of the body and is adapted to be pressed against the outside face of the corresponding wall to cover and close said opening.

It is known in the art, for example, to provide an outside housing with two threaded tube sections projecting toward the inside of the chamber and each adapted to receive a screw passing through the cover plate of the lock fitting installed on the inside face of the structural member.

Also known in the art is a fitting, essentially a lock fitting, having near each end a fixing member adapted to be inserted with the body of the fitting into the corresponding opening in the structural member and having means adapted to inter-engage with the corresponding side surface and the inside edge of the adjacent transverse end of the opening in the structural member when the fixing member is clamped against the wall of the structural member by means of a screw passing through a hole in the cover plate of the fitting.

Although they are satisfactory, the above two embodiments have the essentially esthetic drawback of requiring a screw passing through each end of the cover plate and visible on the visible surface thereof.

FR-A-2 761 719 describes a lock fitting including a first fixing member which has one part at least adapted to retract elastically in the longitudinal direction of the body toward the center of said body to enable it to pass through the opening and to return elastically in the opposite direction to inter-engage with the corresponding side surface of said opening. The other fixing member can be a member fixed to the body and including means for inter-engaging with the side surface at the other transverse end of the opening.

This embodiment enables quick attachment of the lock fitting to the inside wall of the structural member by clipping it into place but prevents easy removal of the fitting. Also, using it to fix a maneuvering housing to the outside wall of the structural member is not recommended because it is theoretically possible, by applying a force to the cover plate in the longitudinal direction of the fitting, to cause the mobile fixing member to retract elastically and thus enable removal of the fitting.

The object of the present invention is to remedy the aforementioned drawbacks of the prior art and to propose a fitting of the aforementioned type which is of simple and reliable structure and has no visible fixing means on the corresponding face of the structural member, although it is fastened to the corresponding wall of the structural member.

SUMMARY OF THE INVENTION

The invention provides an operating fitting for a sliding door or window panel whose stile at the leading edge consists of a structural member having two visible lateral walls between which is an inside chamber of the structural member, the fitting including a body adapted to penetrate into the chamber through an opening on the corresponding visible wall of the structural member and a cover plate which is an integral part of the body and is adapted to be pressed against the outside face of the corresponding wall to cover and close the opening, the fitting having in the vicinity of each end a fixing member including means adapted to bear on the structural member and on the body to press the cover plate against the corresponding visible wall, at least one of the fixing members being adjustable between a first position in which it is possible to insert the body through the opening and a second position in which the cover plate is pressed against the corresponding wall, wherein the adjustable fixing member includes a rotary clamping member adapted to bear on a location other than the visible face of the cover plate so as not to be visible on the corresponding visible face of the structural member, the rotary clamping member being adapted to produce a force clamping the cover plate against the corresponding visible wall of the structural member or to operate or immobilize means producing a force of this kind.

The above structure thus prohibits the use of a screw whose head is visible on the visible face of the cover plate of the fitting.

The rotary clamping member is therefore not visible on the visible face of the structural member. It produces a non-elastic force clamping the cover plate against the visible wall of the structural member, which prevents unauthorized removal of the fitting.

Other embodiments of the present invention will become apparent in the course of the following detailed description.

BRIEF DESCRIPTION OF THE DRAWINGS

In the accompanying drawings, which are provided by way of non-limiting example only.

DETAILED DESCRIPTION OF THE PREFERRED EMBODIMENTS

Figure 1:
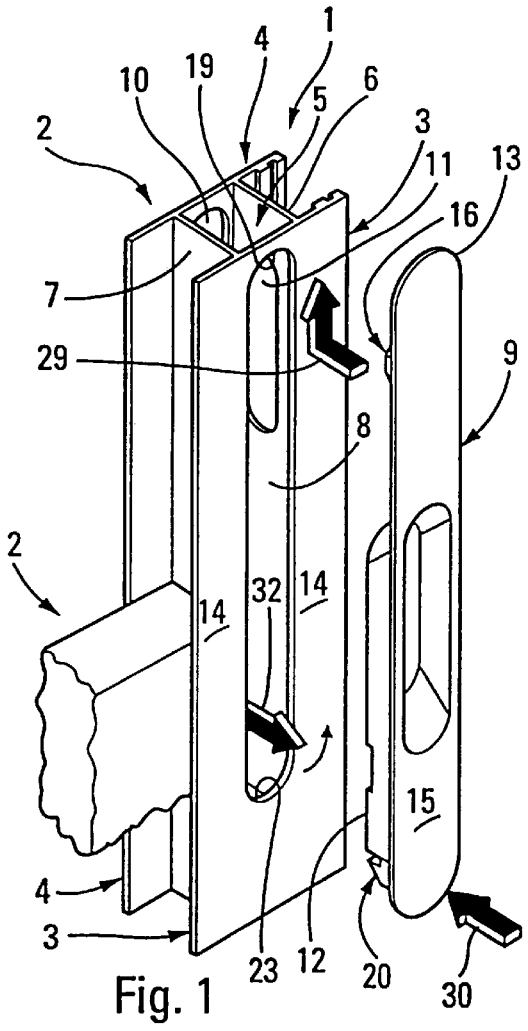
FIG. 1 is a diagrammatic perspective view of a profile constituting the stile at the leading edge of a sliding panel, the structural member having in its two visible faces an opening adapted to receive any embodiment of an operating fitting according to the present invention.

FIG. 1 is a diagrammatic perspective view of a structural member 1 adapted to constitute the stile at the leading edge of a sliding door or window panel 2 shown diagrammatically.

The structural member 1 has two visible lateral walls, namely an outside visible lateral wall 3 facing outward relative to the sliding panel 2 and an inside visible lateral wall 4 facing inward relative to the sliding panel 2.

Between the visible lateral walls 3 and 4 is an inner chamber 5 delimited by an outer first transverse wall 6 constituting the leading edge of the structural member 1 and an inner second transverse wall 7.

The outside lateral wall 3 has an elongate opening 8 adapted to receive an outside housing 9 which it must be impossible to remove from the outside of the structural member 1.

The inside wall 4 similarly has an elongate opening 10 adapted to receive a lock fitting described below.

It can be seen that the leading edge 6 has at least one opening 11 through which a bolt (not shown) of the lock fitting passes and in which it slides.

As shown diagrammatically in FIG. 1, the outside maneuvering fitting or housing 9 in accordance with the present invention has, in the conventional manner, a body 12 adapted to penetrate into the chamber 5 through the opening 8 in the corresponding outside visible wall 3 of the structural member 1 and a cover plate 13 which forms an integral part of the body 12 and is adapted to be pressed against the outside face 14 of the corresponding wall 3 to cover and close the opening 8.

The fitting 9 has near each end a fixing member including means adapted to bear on the structural member 1 and on the body 12 to press the cover plate 13 against said corresponding visible wall 3. At least one of the fixing members can be adjusted between a first position in which it is possible to insert the body 12 through said opening 8 and a second position in which the cover plate 13 is pressed against said outside face 14 of the corresponding visible wall 3.

In accordance with the present invention, the adjustable fixing member includes a rotary clamping member adapted to bear on a location other than the visible face 15 of the cover plate 13 so as not to be visible on the corresponding visible face 3 of the structural member 1. Said rotary clamping member is adapted to create a force for clamping the cover plate 13 against the corresponding visible wall 3 of the structural member 1 or to operate or immobilize means for creating a force of this kind.

Figure 2:
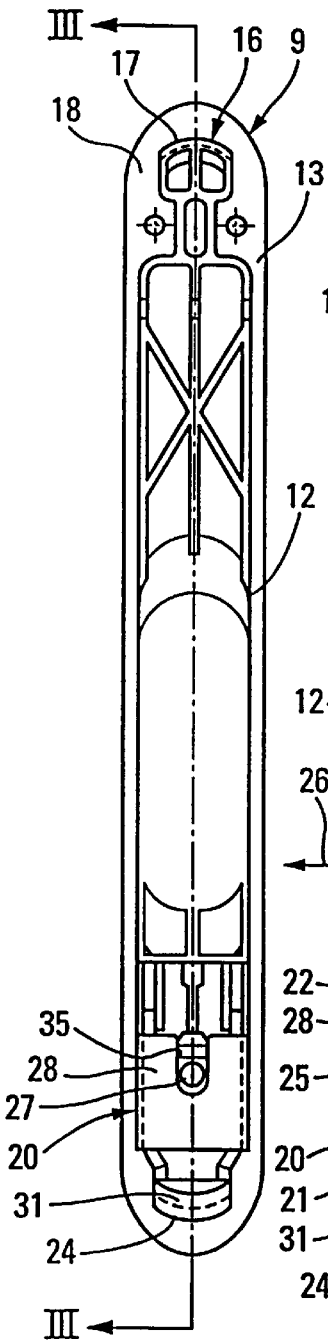
FIG. 2 is a bottom view of the body side of an embodiment of the present invention concerning a maneuvering fitting adapted to be fitted to the outside face of the structural member shown in FIG. 1.
Figure 3:
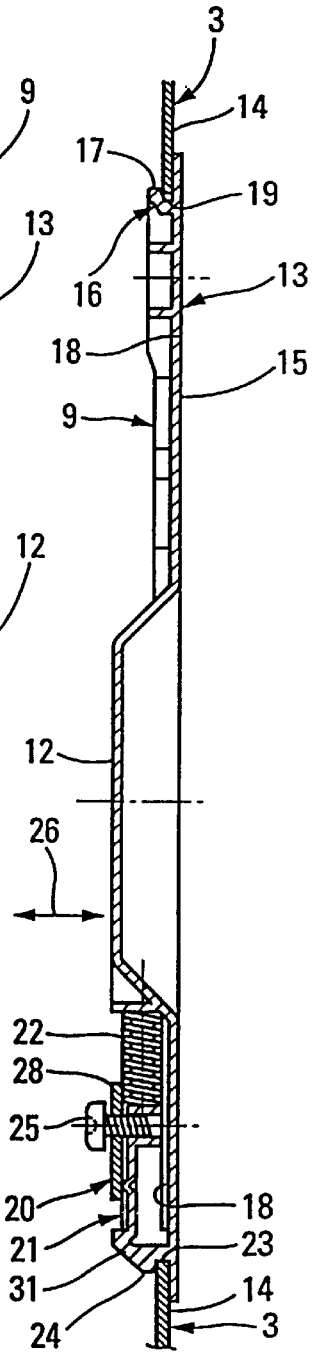
FIG. 3 is a view in section taken along the line III—III in FIG. 2.
Figure 5:
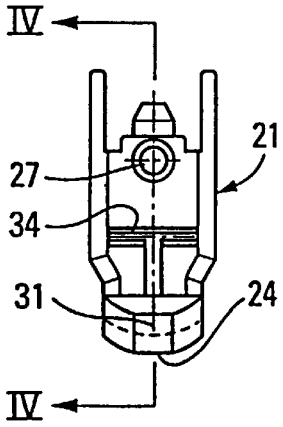
FIG. 5 is a lefthand view of the abutment member shown in FIG. 4.
Figure 4:
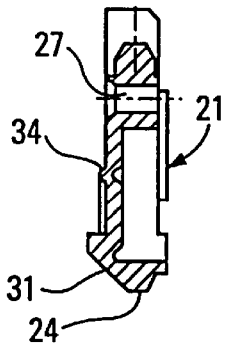
FIG. 4 is a view to a larger scale of a detail from FIG. 3, showing one embodiment of the abutment member shown in that figure in section taken along the line IV—IV in FIG. 5.

In the embodiments shown diagrammatically in FIG. 1 and represented in FIGS. 2 and 3 the operating fitting is a maneuvering housing 9 adapted to be fixed to the outside wall 3 of the structural member 1.

In this embodiment the outside housing 9 includes a fixed first fixing member 16 which is shown in the upper part of FIGS. 2 and 3 and consists of a wall 17 extending from the inside face 18 of the cover plate 13 and away from the face 18 and the body 12. With the inside face 18 of the cover plate 13 it constitutes a re-entrant dihedron adapted to inter-engage with the adjacent transverse end 19 of the opening 8.

The fitting 9 has an adjustable fixing member 20 at the other end which includes an abutment member 21 pressed by a spring 22 against the adjacent transverse ends 23 of the opening 8 in the wall 3.

To this end, the abutment member 20 includes a nose 24 which forms with the inside face 18 of the cover plate 13 a dihedron adapted to inter-engage with the transverse end 23.

In this embodiment the adjustable fixing member 20 includes a rotary clamping member 25 in the form of a screw adapted to be screwed in a direction 26 substantially perpendicular to the outside wall 3 from the opposite inside wall 4 of the structural member 1.

In this embodiment the screw 25 is adapted to be screwed into a threaded hole 27 in the abutment member 21 to clamp said abutment member 21 against a partition 28 fastened to the housing 9 and forming part of the body 12 at a distance from the plate 13. The abutment member 21 can therefore slide between the cover plate 13 and the partition 28.

Accordingly, and as shown diagrammatically in FIG. 1, installation begins by inserting the fixed fixing member 16 into the opening 8 and pushing the housing 9 upward (as seen in the figure) to press the fixing member 16 against the adjacent transverse end 19 of the opening 8, as symbolized by the bent arrow 29.

The other end of the cover plate 13 is then pushed toward the inside of the structural member 1 at the same side as the adjustable fixing member 20, as symbolized by the arrow 30. This presses the inclined surface 31 of the nose 24 against the adjacent transverse end 23 of the opening 8, which pushes the abutment member 21 back against the action of the spring 22 until the nose 24 reaches and passes beyond the transverse end 23.

The spring 22 then pushes the abutment member 21 forward to clip the outside housing 9 to said end 23.

To screw the screw 25 into the hole 27 to clamp the abutment member 21 against the partition 28 and immobilize it there it remains only to insert the screw 25 and a fixing tool through the opposite opening 10 and the chamber 5, as symbolized by the arrow 32.

Note that the rib 34 on the back of the abutment member 21 comes into contact with the partition 28 and obliges the member 21 to pivot when the screw 25 is turned to hold the nose 24 in contact with the transverse end 23 of the opening 8.

Immobilizing the abutment member 21 opposes unauthorized removal of the outside housing 9 from the outside of the panel.

The plate 28 includes a longitudinal slot 35 through which the screw 25 passes to facilitate sliding of the abutment member 21 with the screw 25 already inserted in the hole 27.

In the embodiment shown in FIGS. 6 to 9 the operating fitting 41 is a lock fitting adapted to be fixed to the inside wall 4 of the structural member 1. It includes an extruded casing 42 with a substantially U-shaped cross section in which slides longitudinally (arrow 43) a sliding assembly 44 including a bolt-carrier 45 with an opening 46 adapted to receive a bolt (not shown) whose hook projects through the opening 11 in the side 6 of the structural member 1.

Figure 8:
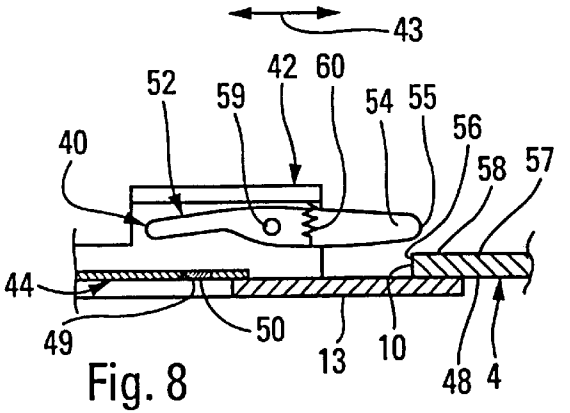
FIG. 8 is a view to a larger scale of a detail from FIG. 7, showing a lever in its rest position.
Figure 9:
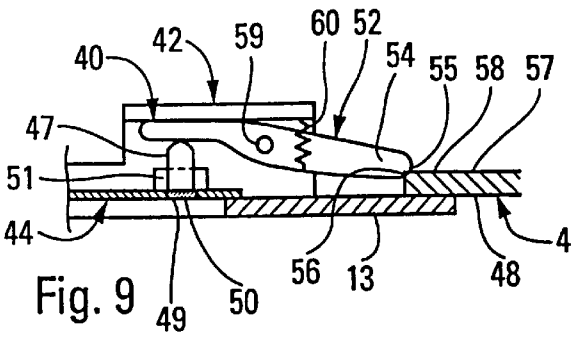
FIG. 9 is a view similar to FIG. 8, showing the lever in a position in which it has moved until it abuts against the transverse end of the opening in the structural member.

The adjustable fixing member 40 of the fitting 41 includes rotary clamping means 47 adapted to be operated from the visible face 48 of the inside wall 4 of the structural member 1 via a hole 49 in the cover plate 13 (FIG. 11) or in a wall of the sliding assembly 44 (FIGS. 8 and 9). The hole 49 can be concealed by a removable cover 50.

This is perfectly acceptable on the inside wall 4 of the sliding panel 2.

In the embodiments shown in FIGS. 7 to 11 the rotary clamping means 47 are in the form of a screw adapted to be screwed into a nut 51 fastened to the casing 42 and to displace—either with a sliding motion due to a cam effect (FIGS. 10 and 11) or in rotation (FIGS. 7 to 9)—an abutment member 52, 53 adapted to bear on the casing 42 and having at one end 54 a surface 55 with a predetermined shape in cross section adapted to bear on the inside edge 56 and/or on the inside face 57 at the corresponding transverse end 58 of the opening 10.

Figure 7:
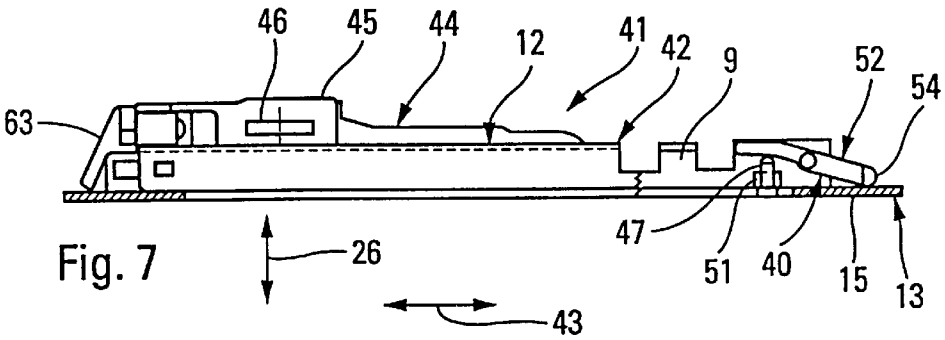
FIG. 7 is a cutaway profile view of one embodiment of a lock fitting as shown in FIG. 6.

In the embodiment shown in FIGS. 7 to 9 the abutment member 52 is a lever which pivots on a pin 59 fastened to the casing 42. If necessary, a spring 60 holds the lever in its raised position (see FIG. 8), which is the position in which the fitting 41 can be inserted into the opening 10.

As shown diagrammatically in FIG. 9, the screw 47 screwed into the nut 51 bears on the opposite end of the lever 52 to immobilize the surface 55 against the inside edge 56 and the inside face 57 at the side 58 in order to press the cover plate 13 against the wall 4 and immobilize the fitting 41 against any movement in the longitudinal direction 43.

Figure 11:
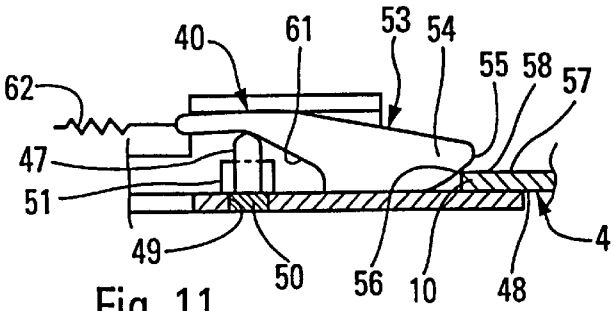
FIG. 11 is a view to a larger scale of a detail from FIG. 10.
Figure 6:
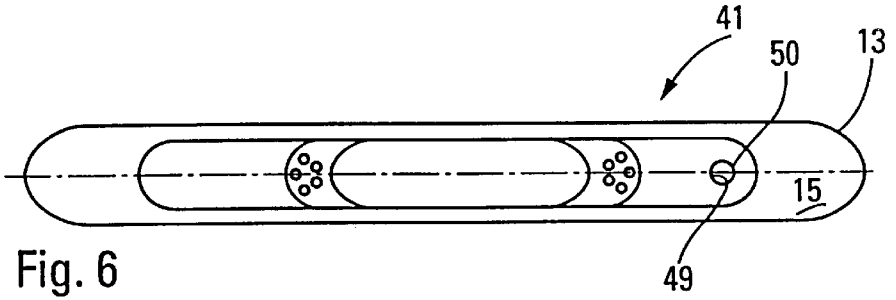
FIG. 6 is a front view showing the visible face of another embodiment of an operating fitting in accordance with the present invention.
Figure 10:
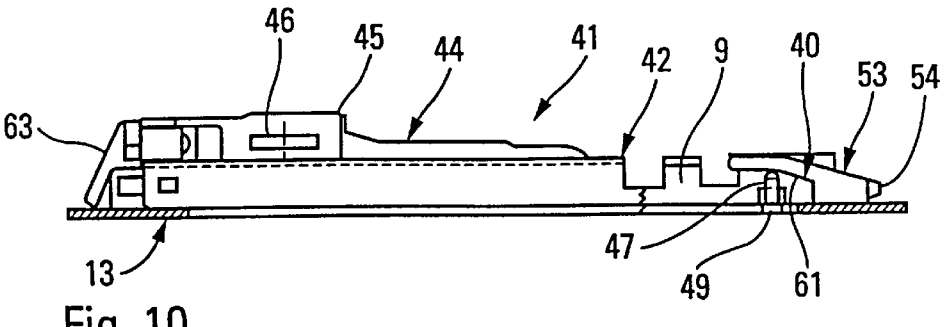
FIG. 10 is a view similar to FIG. 7 of another embodiment of the present invention.

In the embodiment shown in FIGS. 10 and 11 the abutment member 53 is adapted to slide inside the casing 42 in the longitudinal direction 43. When it is screwed in, the screw 47 comes into contact with the inclined surface 61 and pushes the abutment element 53 back toward the transverse end 58, where applicable against the action of a return spring 62.

The lock fitting 41 has a fixing member 63 of any type at the other end. The fixing member can be a mobile fixing member of any type fastened to the casing 42 after it is installed.

Figure 12:
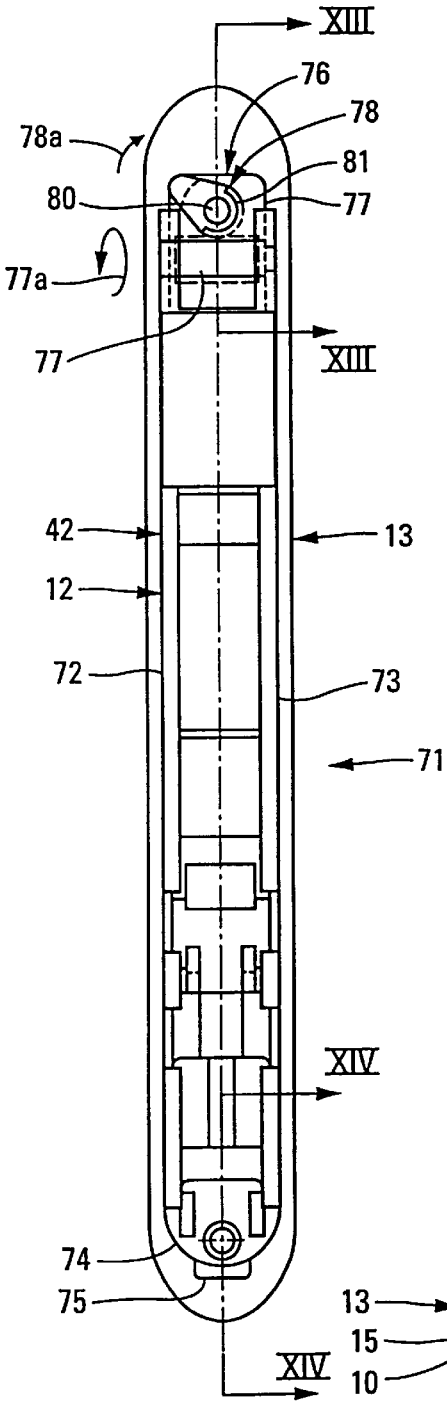
FIG. 12 is a bottom view of the body side of another embodiment of an operating fitting in accordance with the present invention.
Figure 13:
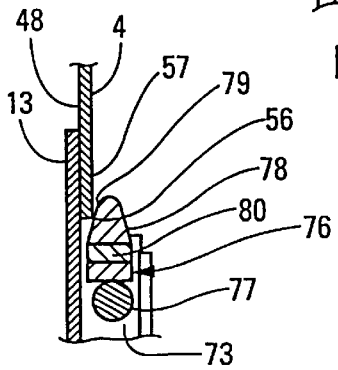
FIG. 13 is a view in section taken along the line XIII—XIII in FIG. 12.
Figure 14:
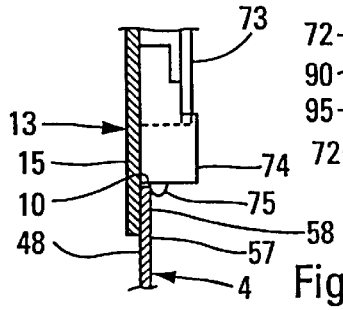
FIG. 14. is a view in section taken along the line XIV—XIV in FIG. 12.

In the embodiment shown in FIGS. 12 to 14 the lock fitting 71 is similar to the fitting 41 and includes an extruded casing 42 which has a substantially U-shaped cross section with two substantially parallel flanges 72, 73.

The fitting 71 has a fixed fixing member 74 of any type at one end, for example a fitting including a nose 75 constituting with the cover plate 13 an acute angle dihedron adapted to receive the corresponding transverse end of the opening 10 which receives the fitting 71 (see FIG. 14). The fitting 71 has an adjustable fixing member 76 at the other end and that fixing member will now be described.

The following description could apply equally to an outside housing 9 having a body having a substantially U-shaped cross section including two substantially parallel flanges 72, 73 at least in line with the adjustable fixing member 76.

In this embodiment the fitting 71 includes a rotary clamping member 77 in the form of a screw passing through a corresponding smooth hole in each of the two flanges 72, 73 forming a bearing allowing the screw 77 to rotate freely relative to the flanges 72, 73.

The screw 77 is adapted to displace at least one abutment member 78 to press a surface 79 of the member 78 which has a predetermined shape in cross section against the inside edge and/or the inside face at the corresponding end of the opening 10.

In the embodiment shown in FIGS. 12 and 13 the abutment member 78 pivots on a pin 80 substantially perpendicular to the cover plate 13. It has on its peripheral surface 81 facing the screw 77 a thread complementary to that of the screw 77 constituting a lead screw for pivoting the member 78 (arrow 78*a*) when the screw 77 is turned (arrow 77*a*).

Opposite the cylindrical surface 81 the member 78 is of substantially frustoconical shape with a surface 79 adapted to bear on the inside edge 56 and on the inside face 57 at the transverse end 58 of the opening 10 in the structural member.

The screw 77 can easily be turned by means of a tool passing through the side 6 of the structural member, through an appropriate hole formed in said side or through the opening 11 through which a bolt passes.

Figure 15:
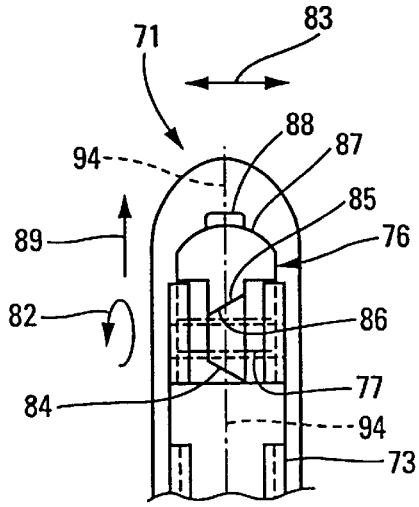
FIG. 15, is a partial view to a larger scale, similar to FIG. 12, of another embodiment of the present invention.

In the embodiment shown in FIG. 15 the screw 77 turns freely between the lateral flanges 72 and 73 (arrow 82) and moves in the transverse direction 83 a nut 84 which is prevented from turning and which has an inclined face 85 inter-engaged with a complementary inclined face 86 of an abutment member 87 which has a nose 88 the same shape and with the same function as the nose 24 of the member 21 described above. It abuts against the transverse end 58 of the opening 10 when it is moved in the direction of the arrow 89.

Figure 16:
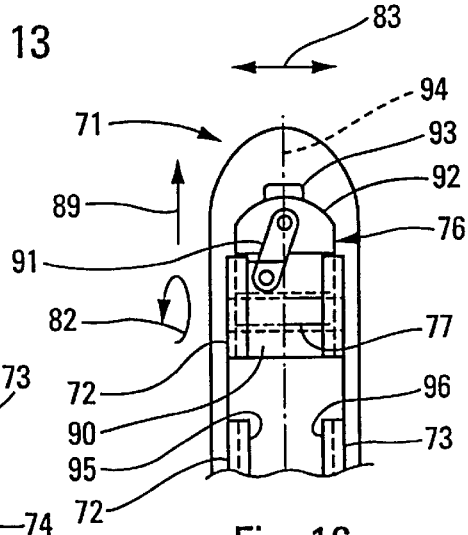
FIG. 16 is a view similar to FIG. 15 of another embodiment of the present invention.

In the embodiment shown in FIG. 16 the screw 77 moves in the transverse direction 83 a nut 90 which moves parallel to itself like the nut 84 shown in FIG. 15. The link 91 is articulated to one end of the nut 90 and at its other end to an abutment member 92 which has a nose 93.

In a retracted position shown in FIG. 16 the nut 90 is against the lateral flange 72, the link 91 is at an angle to the longitudinal axis 94 of the fitting 71 and the abutment member 92 is in its retracted position, in which the fitting 71 can be inserted into the corresponding opening.

When the screw 77 is turned (arrow 82) from this retracted position the nut 90 is moved transversely toward the axis 94 and the link 91 pushes the abutment member 92 back in the direction 89 against the corresponding transverse end 58 of the opening 10 to immobilize the fitting 71 in all directions against the corresponding wall 4 of the structural member 1.

If the screw 77 is turned the other way the abutment member 92 is returned to its retracted position, releasing the corresponding transverse end of the opening, which releases the fitting 71.

Of course, the abutment member 87 shown in FIG. 15 and the abutment member 92 shown in FIG. 16 are each shaped to retain them on the fitting 71 with only one degree of freedom, corresponding to the ability to slide in the direction of the longitudinal axis 94. For example, the abutment members 87, 92 each have shaped portions which bear under respective lips 95, 96 formed at the free end of the flanges 72 and 73 and extending toward the other flange 73, 72 in a direction substantially parallel to the cover plate 13.

Figure 17:
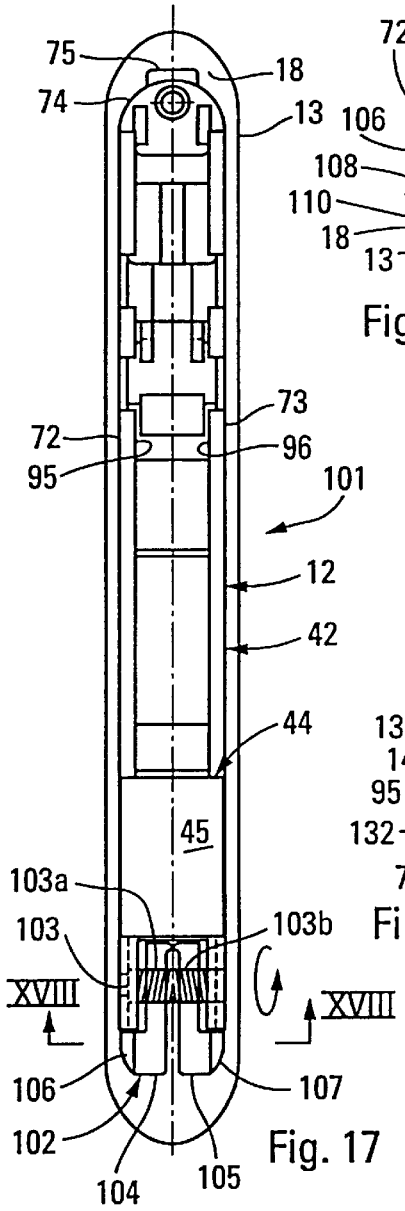
FIG. 17. is a view similar to FIG. 12 of another embodiment of the present invention.

In the embodiment shown in FIG. 17 the fitting 101 is a lock fitting with two lateral flanges 72, 73 each of which has a respective lip 95, 96.

At the end which is at the top in FIG. 17 the fitting 101 has a fixed fixing member 74 of any type, for example one similar to that described above for the fitting 71 shown in FIG. 12.

The fitting 101 has at the other end an adjustable fixing member 102 including a screw 103 which can rotate in a smooth hole in each of the two flanges 72, 73.

The screw 103 is divided into two sections 103*a*, 103*b* with threads in opposite directions in a median transverse plane perpendicular to the plane of the figure and containing the longitudinal axis 94.

The threads of the sections 103*a*, 103*b* respectively mesh with two abutment members 104, 105 adapted to move in opposite direction along the transverse axis 83 when the screw 103 is turned (arrow 82).

Figure 19:
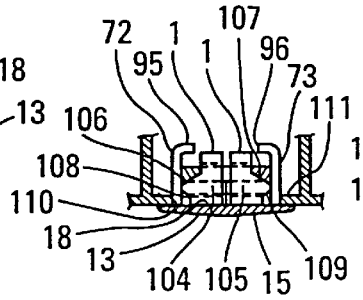
FIG. 19 is a partial view corresponding to part of FIG. 18 and showing the adjustable fixing member in its retracted position.
Figure 18:
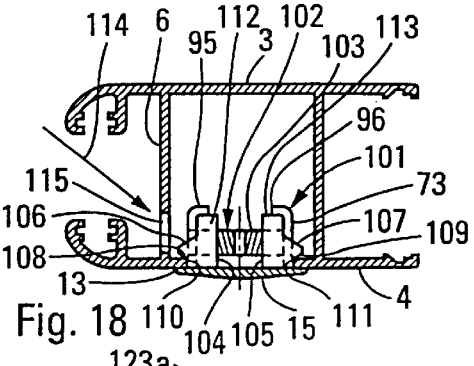
FIG. 18.is a view in section taken along the line XVIII—XVIII in FIG. 17, showing the fitting installed on a visible face of a structural member and with its adjustable fixing member in its deployed position.

As shown in FIGS. 18 and 19, each abutment member 104, 105 has a respective beak 106, 107 projecting outward in the transverse direction 83 and having a respective sloped surface 108, 109 facing the cover plate 13 and forming with the inside face 18 of the cover plate 13 an acute angle dihedron adapted to inter-engage with the inside face of the corresponding longitudinal lateral side 110, 111 of the opening 10 receiving the fitting 101.

In the position shown in FIG. 18 the two abutment members 104, 105 are in their deployed position and inter-engaged with the corresponding longitudinal lateral side 110, 111 to press the cover plate 13 against the corresponding lateral wall 4 of the structural member 1 and oppose any force tending to slide the fitting 101 along the longitudinal axis 94 relative to said wall 4.

In the position shown in FIG. 19 the two abutment members 104, 105 are in their retracted position and do not oppose insertion of the fitting 101 into the opening 10 in the wall 4.

If necessary, and as shown in FIG. 18, the two abutment members 104, 105 can have respective shaped portions 112, 113 which, in the deployed position of the members 104, 105, engage under the corresponding lips 95, 96 to strengthen the assembly, which can be beneficial if the fitting 101 is a maneuvering housing mounted on the outside wall 3 of the structural member 1.

As in the case of the fitting 71, the screw 103 can easily be turned by means of a tool, symbolized by the arrow 114, passing through the side 6 of the structural member 1, through an opening 115 provided for this purpose in the side 6 or through the bolt opening 11.

Figure 20:
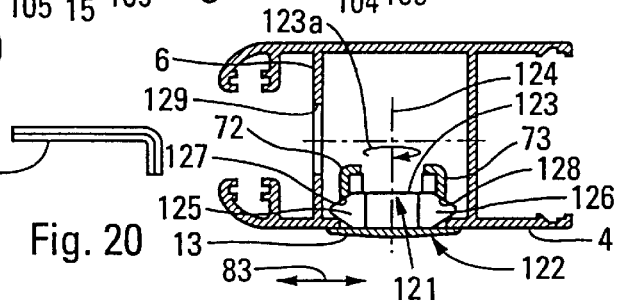
FIG. 20 is a view similar to FIG. 18 of another embodiment of the present invention.

In the embodiment shown in FIG. 20 the body 12 has a substantially U-shaped cross section including two substantially parallel flanges 72, 73 at least in line with the adjustable fixing member 121. This embodiment is therefore equally applicable to a maneuvering housing mounted on an outside wall 3 and a lock fitting mounted on an inside wall 4.

The embodiment shown corresponds to a lock fitting 122 mounted on an inside wall 4.

In this embodiment the fixing member 121 includes a rotary clamping member 123 adapted to turn about an axis 124 substantially perpendicular to the cover plate 13.

The clamping member 123 has wedge-shaped projections 125, 126 at two diametrally opposite ends. Each projection 125, 126 is adapted to locate between the two flanges 72, 73 for inserting the body 9 into the chamber 5 and then, in the deployed position shown in FIG. 20, to project through an opening 127, 128 in the corresponding flange 72, 73 of the body 12 to bear on the inside face and the inside edge of the corresponding lateral side 110, 111 of the opening 10 and on the side of the opening 127, 128 in the corresponding flange 72, 73 when the rotary clamping member 123 is turned through an angle of not more than about 90° (arrow 123*a*).

In the embodiment shown, which corresponds to a lock fitting 122 fixed to the inside lateral wall 4 of the structural member 1, the clamping member 123 is operated through an opening 129 in the side 6 of the structural member 1 by a hex key 130.

Of course, if a clamping member 123 is mounted on an outside housing mounted on the outside wall 3 of the structural member 1 the hex key 130 can be inserted into the chamber 5 through the opening 10 formed in the inside wall 4.

In the embodiments shown in FIGS. 21 to 25 the body 12 of the fitting 131 has a substantially U-shaped cross section including two substantially parallel flanges 72, 73 at least in line with the adjustable fixing member and each flange has along its free edge a lip 95, 96 extending toward the other flange 73, 72.

In these embodiments the adjustable fixing member includes a bearing member with two shoulders 132, 133 each adapted to bear under the corresponding lip 95, 96 of the body 9.

Also, the rotary member and the bearing member have respective and complementary means for pressing the cover plate 13 against the corresponding visible face 3, 4 of the structural member 1 when the corresponding rotary clamping member is turned or inserted through an opening in the side 6 of the structural member 1 into a hole in the bearing member extending at least in the transverse direction 83 of the body 12.

Figure 21:
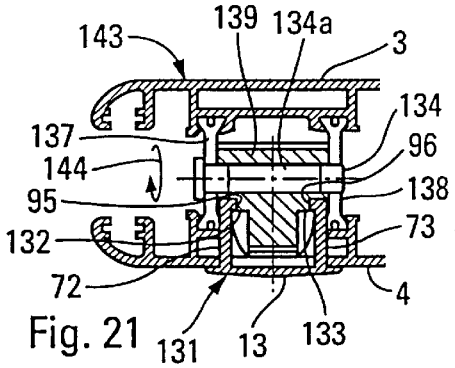
FIG. 21 is a view similar to FIG. 18 of another embodiment of the present invention.
Figure 22:
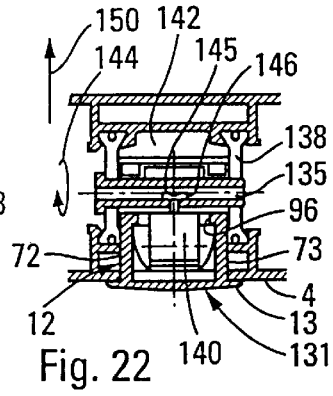
FIGS. 22 to 25 are views similar to FIG. 18 and each showing another embodiment of the present invention.
Figure 23:
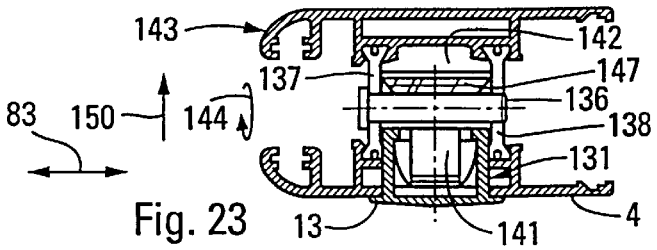

FIGS. 21 to 23 are diagrammatic representations of a particular type of structural member, which is well known in the art, and which has a width in the transverse direction 83 substantially corresponding to the width of the body 12. The rotary clamping member 134, 135, 136 is then adapted to bear on the smooth sides of a hole in each of the two transverse walls 137, 138 of the structural member 143.

The clamping member 134, 135, 136 can therefore turn freely between its two walls 137, 138.

The corresponding bearing member 139, 140, 141 has a hole extending substantially in the transverse direction 83 to receive the corresponding rotary clamping member 134, 135, 136.

Obviously the body 12 of the fitting 131 fitted with the corresponding bearing member 139, 140, 141 must be inserted into the chamber 142 before inserting the clamping member 134, 135, 136 through the side 137 of the structural member 143.

In the embodiment shown in FIG. 21 the rotary clamping member 134 has a body 134*a* which is eccentric at least over the part of its length between the two flanges 72 and 73 so that rotation of the member 134 draws the bearing member 139 against the lips 95, 96 of the body 12 (arrow 150) and thus presses the cover plate 13 against the wall 3, 4 of the structural member 143. The rotary member 134 is rotated from the outside, through the side 137 of the structural member 143, as symbolized by the arrow 144.

In the embodiment shown in FIG. 22 the rotary clamping member 135 has at its periphery an eccentric T-shaped cross section groove 145 adapted to receive a complementary T-shaped head 146 of the bearing member 140.

Thus when the clamping member 135 is turned (arrow 144) the bearing member 140 is drawn toward the center of the chamber 142 (arrow 150) and the cover plate 13 is pressed against the wall 4 of the structural member 143 by the shoulders 132 and 133 and the lips 95, 96.

In the embodiment shown in FIG. 23 the part of the bearing member 141 receiving the clamping member 136 has an elastic, for example elastomer, pad 147 which has a hole in it whose axis is slightly offset relative to the center of the clamping member 136 and whose diameter is significantly smaller than that of said clamping member 136. Forcing the clamping member 136 into the hole in the elastomer pad 147 compresses the pad, which amounts to drawing the bearing member 141 toward the inside of the chamber 142 and pressing the cover plate 13 against the wall 4 of the structural member 143.

Figure 24:
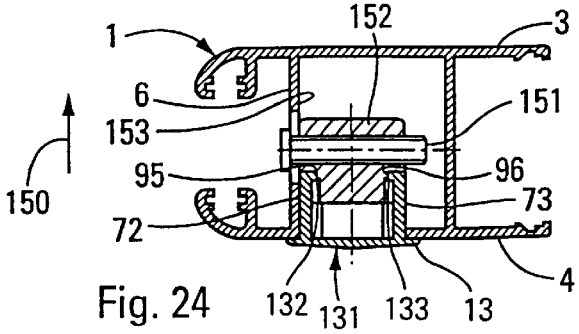

In the embodiment shown in FIG. 24, which corresponds to a structural member 1 whose chamber is significantly wider in the transverse direction 83 than the body 12, the rotary clamping member 151 is a screw turning freely in a corresponding hole in the side surface 6 of the structural member 1 and screwed into a corresponding threaded hole in a bearing member 152 including the shoulders 132 and 133 described above. Turning the screw 151 from the outside through the side 6 of the structural member presses the bearing member 152 and the body 12 of the fitting 131 against the inside face 153 of the side 6.

Figure 25:
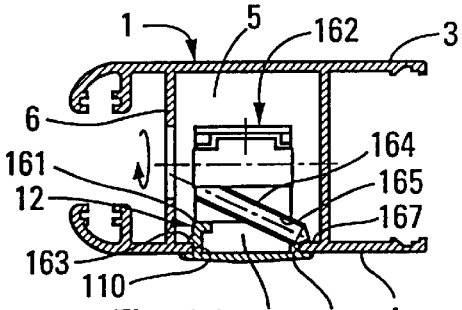

In the embodiment shown in FIG. 25 the body 12 has a lug 163 on the outside face of a flange 161, at least in line with the adjustable fixing member 162, and this lug is adapted to inter-engage with the inside face of the corresponding lateral side 110 of the opening 10 when the body 12 has been inserted into the chamber 5 and then to slide along said side 110.

The rotary clamping member 164 is a screw which screws into a threaded hole 165 in the bearing member 166 and extending obliquely toward the lateral side 111 of the opening 10 opposite the lug 163 and toward the cover plate 13 so that, in the screwed-in position of the screw shown in FIG. 25, the end of the screw 164 bears against the inside face 167 and the inside edge of said opposite lateral side 111 of the opening 10. The bearing member 166 also includes means for transmitting to the body 12 the force produced by the screw 164 pressing the cover plate 13 against the wall 4 of the structural member 1 and the flange 161 against the side 110.

Thus many embodiments of an adjustable fixing member have been described which, with the exception of the embodiment shown in FIGS. 2 to 11, can be used equally on an outside housing or on a lock fitting. The adjustable fixing member has a rotary clamping member that is not visible from, and is therefore inaccessible from, the corresponding visible face of the panel, although it is easy to fit and to remove and clamps the fitting to the corresponding wall of the structural member in a non-elastic manner.

Of course, the invention is not limited to the embodiments described above and shown in the figures, to which many changes and modifications can be made without departing from the scope of the invention.

For example, the shoulders 132, 133 shown in FIGS. 21 to 25 can be replaced by a rivet passing through the flanges 72 and 73 and the bearing member 139, 140, 141, 152 or 166.

What is claimed is:

1. An operating fitting for a sliding door or window panel whose stile at a leading edge consists of a structural member having first and second visible lateral walls between which is an inside chamber of the structural member, said fitting including a body for penetrating into said chamber through a first opening in the first visible lateral wall of said structural member and a cover plate which is an integral part of said body and is pressed against a visible face of the first visible lateral wall to cover and close said first opening, said fitting having in the vicinity of each end a fixing member including means for bearing on said structural member and on said body to press the cover plate against said first visible lateral wall, at least one of said fixing members being adjustable between a first position in which said body is insertable through said first opening and a second position in which said cover plate is pressed against said first visible lateral wall, said at least one adjustable fixing member including a rotary clamping member which bears on a location other than a visible face of said cover plate so as not to be visible on said visible face of said first visible lateral wall of said structural member, said rotary clamping member producing a force clamping said cover plate against said first visible lateral wall of said structural member or operating or immobilizing means producing a force of this kind.

2. The operating fitting claimed in claim 1, taking the form of a maneuvering housing to be fixed to said first visible lateral wall of said structural member, wherein said rotary clamping member is a screw to be screwed in a direction substantially perpendicular to said first visible lateral wall from a second opening formed in said second visible lateral wall of said structural member, said screw cooperating with a threaded hole in an abutment member, and said abutment member being pressed by a spring against a transverse end of said first opening in said first visible lateral wall to clamp said abutment member against a partition fastened to said housing.

3. The operating fitting claimed in claim 1, taking the form of a lock fitting to be fixed to said first visible lateral wall of said structural member and including a casing with a substantially U-shaped profile in Cross section inside which a sliding assembly slides longitudinally, wherein said rotary clamping member being operable from said visible face of said first visible lateral wall through a hole in said cover plate or in a wall of said sliding assembly, and said hole being concealable by a removable cover.

4. The operating fitting claimed in claim 3 wherein said rotary clamping member is a screw cooperating with a nut, said net being fastened to said casing, said screw displacing an abutment member either with a sliding motion by virtue of a cam effect or in rotation, said abutment member bearing on said casing and having at one end a surface having a predetermined shape in cross section for bearing on at least one of an inside edge and an inside face at a corresponding transverse end of said first opening.

5. The operating fitting claimed in claim 1 wherein said body has a substantially U-shaped cross section with two substantially parallel flanges at least in line with the at least one adjustable fixing member and said rotary clamping member is a screw passing through a smooth hole in each of said two flanges, said screw displacing at least one abutment member having a surface having a predetermined shape in cross section to press said surface of said at least one abutment member against at least one of an inside edge and an inside face at a corresponding transverse end of said first opening.

6. The operating fitting claimed in claim 1 wherein said body has a substantially U-shaped cross section with two substantially parallel flanges at least in line with said at least one adjustable fixing member and said rotary clamping member turns about an axis substantially perpendicular to said cover plate and has a wedge-shaped projection at each end of a diameter, each wedge-shaped projection being located between the two flanges for insertion of said body through said first opening and projecting through a hole in a corresponding flange of said body to bear on an inside face and on an inside edge of a corresponding lateral side of said first opening and on an edge of said hole in the flange when said rotary clamping member is turned through an angle of not more than 90°.

7. The operating fitting claimed in claim 1 wherein said body has a substantially U-shaped cross section with two substantially parallel flanges at least in line with said at least one adjustable fixing member, if necessary each said flange has a lip along a free edge extending toward the other flange, said at least one adjustable fixing member includes a bearing member with means for bearing on said body, said rotary clamping member and said bearing member include respective and complementary means for pressing said cover plate against said visible face of said first visible lateral wall of said structural member when said rotary clamping member is turned or inserted through an opening in a side of said structural member into a hole in said bearing member extending at least in a transverse direction of said body.

8. The operating fitting claimed in claim 7 wherein said structural member has two transverse walls and said rotary clamping member bears on sides of at least one hole in at least one of said two transverse walls of said structural member, and said hole in said bearing member extends substantially in said transverse direction of said body.

9. The operating fitting claimed in claim 7 wherein said body has a lug on an outside face of a first one of said flanges at least in line with said at least one adjustable fixing member, said lug inter-engaging with an inside face of a corresponding lateral side of said first opening when said body has been inserted into said chamber and then slid along said lateral side, and said rotary clamping member is a screw to be screwed into said hole in said bearing member, said hole in said bearing member extending obliquely toward the lateral side of said first opening opposite said lug and toward said cover plate so that, in a screwed-in position of said screw, an end of said screw bears against an inside face and an inside edge of said lateral side of said first opening opposite said lug.

* * * * *